United States Patent [19]

de Mendez et al.

[11] Patent Number: 4,810,201

[45] Date of Patent: Mar. 7, 1989

[54] ELECTRICAL COUPLING USING A MATERIAL HAVING SHAPE MEMORY

[75] Inventors: Michel de Mendez, Montlhery; Jean J. Negre, Nanterre; Gérard Guenin, Meyzieu; Guy Herubel, Marly le Roi, all of France

[73] Assignee: Souriau & Cie, Boulogne Billancourt Cedex, France

[21] Appl. No.: 887,713

[22] Filed: Jul. 21, 1986

[51] Int. Cl.[4] ..... H01R 13/20

[52] U.S. Cl. ..... 439/161

[58] Field of Search ..... 339/30, DIG. 1, 278 C; 439/161

[56] References Cited

U.S. PATENT DOCUMENTS

| | | | |
|---|---|---|---|
| 3,906,623 | 9/1975 | Clabburn et al. | 29/628 |
| 3,985,950 | 10/1976 | Maltz | 174/88 C |
| 4,634,201 | 1/1987 | Kemka | 439/161 |
| 4,717,352 | 1/1988 | De Mendez et al. | 439/161 |
| 4,720,270 | 1/1988 | Guenin et al. | 439/161 |

FOREIGN PATENT DOCUMENTS

| | | | |
|---|---|---|---|
| 0053745 | 6/1982 | European Pat. Off. | 339/30 |
| 0081372 | 6/1983 | European Pat. Off. . | |
| 0123376 | 6/1984 | European Pat. Off. . | |
| 0112618 | 7/1984 | European Pat. Off. . | |
| 1327441 | 8/1973 | United Kingdom . | |
| 1579734 | 11/1980 | United Kingdom | 339/30 |
| 2128039A | 4/1984 | United Kingdom . | |

OTHER PUBLICATIONS

French Search Report, FR 85 04 040.
French Search Report, FR 85 04 041.
French Search Report, FR 85 04 042.
"Shape Memory Effect, Superleasticity and Damping in Cu-Zn-Al Alloys", Report 78R1, Katholieke Universiteit Leuven, Belgium, by L. Delaey et al., Feb. 1, 1978.
French Search Report, IEEE Transactions On Components, Hybrids and Manufacturing Technology, vol. CHMT-3, No. 2, Jun. 1980, pp. 226-232, IEEE, New York, U.S. .
C. J. Evans, "Connector Finishes, Tin in Place of Gold," p. 226.

*Primary Examiner*—Gil Weidenfeld
*Assistant Examiner*—P. Austin Bradley
*Attorney, Agent, or Firm*—Nixon & Vanderhye

[57] ABSTRACT

The coupling is constituted by a split sleeve (1) made of material having shape memory. The sleeve (1) is capable of occupying a first memorized shape state (I) in which electrical and mechanical interconnection is provided between electrical conductors (2, 3). In a second memorized shape state (II) the sleeve allows the conductors to be freely inserted or removed from the sleeve (1). The sleeve is capable of passing reversibly between said first and second states under the effects of temperature changes.

10 Claims, 3 Drawing Sheets

ELECTRICAL COUPLING USING A MATERIAL HAVING SHAPE MEMORY

The present invention relates to a coupling for providing an electrical connection and made of a material having shape memory

BACKGROUND OF THE INVENTION

Conventional couplings or electrical connection devices are generally constituted by metal sleeves or rings which are intended to be engaged on two electrically conductive zones for interconnection and to perform both mechanical and electrical interconnection thereof. Frequently, said mechanical and electrical interconnection are provided by means of a sleeve which is deformed or crimped. Crimping permanently deforms the sleeve to a considerable extent, and, generally speaking, couplings of this type can usually be used once only since the considerable sleeve deformation which occurs during crimping prevents the initial properties of elasticity and malleability of the sleeve from being subsequently reused.

However, recent work in this field has made use of materials having shape memory, thereby enabling this type of equipment to be re-used several times in succession. For example, proposals have been made to make a coupling sleeve, or at least a portion thereof, in a material having shape memory, i.e. a material capable of giving the sleeve the property of occupying to different shapes depending on the temperature of the sleeve relative to a transition temperature of the material from which it is made. These two shapes correspond to an expanded shape for the sleeve in which electrical and mechanical interconnection of the contact zones is not ensured and a retracted or non-expanded state of the sleeve in which both electrical and mechanical connection of the contact zones are, indeed, provided.

Couplings of this type are described, in particular, in European patent application published under the No. 0 112 618, and in Research Disclosure Publication No. 212, December 1981, page 442, abstract No. 21237, published in Havant Hampshire, GB in an article entitled "Method of attaching coiled leads to electrodes or electrode pins".

However, the types of coupling described in the above-specified documents necessarily require a mechanical force or stress to be applied externally to the sleeve in order to return it adequately to its expanded condition over a plurality of connection-disconnection cycles, said force or stress being capable of returning the sleeve to its expanded shape state and of returning the conductive zones to a state in which mechanical and electrical interconnection is absent.

Consequently, and in particular concerning couplings of the type described in above-mentioned European patent application No. 0 112 618, a resilient element or auxiliary spring in the form of a split metal ring concentric with the sleeve and in contact therewith is provided in order to ensure a re-usable connection function for substantially all types of conductive zone which are compatible with the size of the sleeve-spring assembly. With reference to the above-specified Research Disclosure, the coupling is constituted by a simple sleeve which can only be used in the presence of conductive zones for interconnection which are capable of exerting an external force suitable for returning a sleeve to its expanded state. As shown in the drawing of said publication, this type of coupling can only be used repetitively if one of the conductive zones possesses radial elasticity relative to the sleeve and is constituted by a spring or a coil.

Preferred embodiments of the present invention remedy the above drawbacks by implementing an electrical coupling capable of being re-used many times, without requiring any auxiliary resilient or spring system.

Preferred embodiments of the present invention also provide an electrical coupling suitable for being mounted to provide electrical connection after the corresponding conductive contact zones have been wired up.

SUMMARY OF THE INVENTION

An electrical coupling in accordance with the invention is in the form of a split sleeve made of a material having shape memory. The sleeve is suitable for occupying a first memorized state whose shape corresponds substantially to an initial shape state thereof, which state is suitable for maintaining mechanical and electrical interconnection of the electrical contact zones. In addition, the sleeve is capable of occupying a second memorized state whose shape is obtained by local modification of at least one zone of the sleeve structure, with said second state being suitable for free insertion and/or removal of the electrical contact zones into and out from a central zone of the sleeve. The sleeve passes reversibly between said first and second memorized shape states when the temperature of at least one local zone of the sleeve structure is modified.

The invention is applicable to connecting electrical cables of all types, for example cables have circular section conductors, flat cables, and the contacts and connecting components of releasable connector fittings.

BRIEF DESCRIPTION OF THE DRAWINGS

Embodiments of the invention are described by way of example with reference to the accompanying drawings, in which.

Figure 1A:
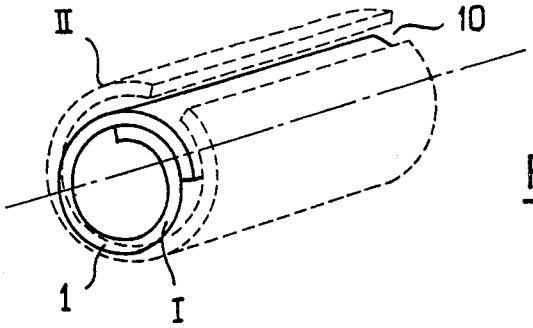
FIGS. 1*a* and 1*b* show two advantageous embodiments of a coupling in accordance with the present invention.
Figure 1B:
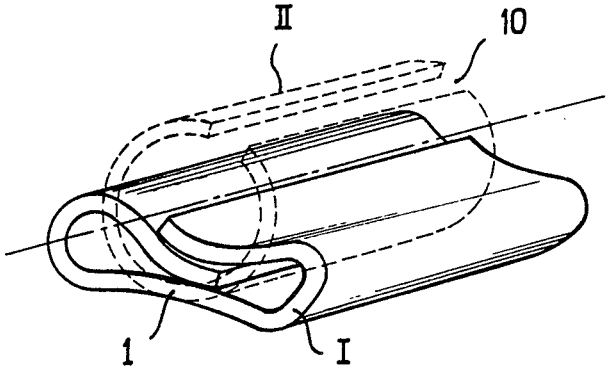
Figure 3B:
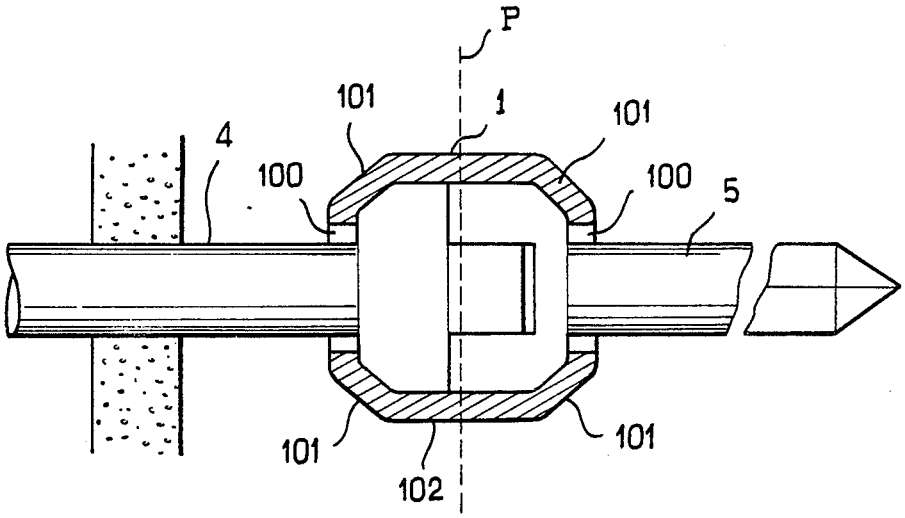
Figure 3A:
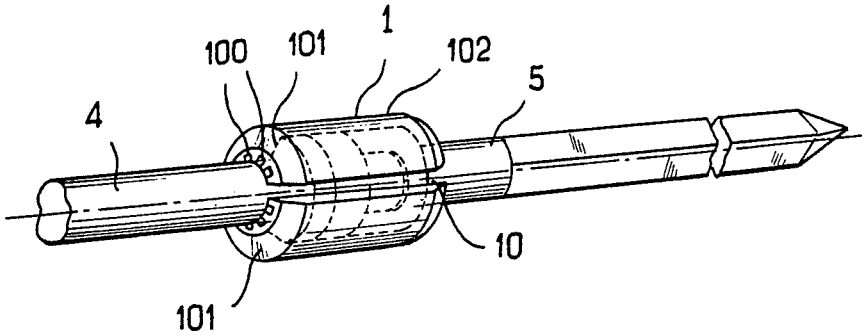
Figure 4A:
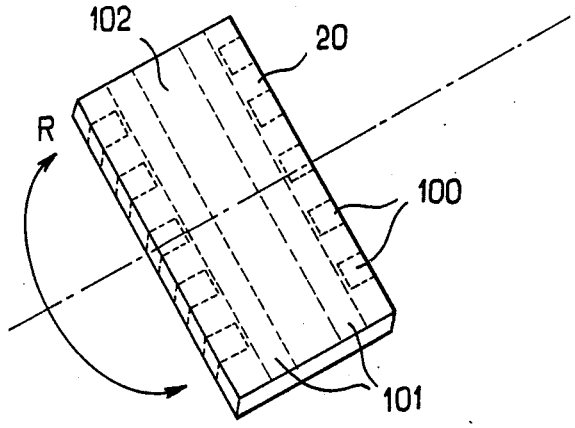
Figure 4B:
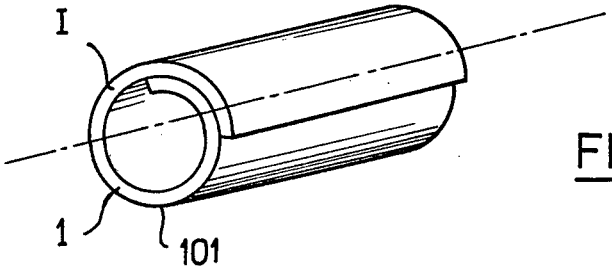
Figure 4C:
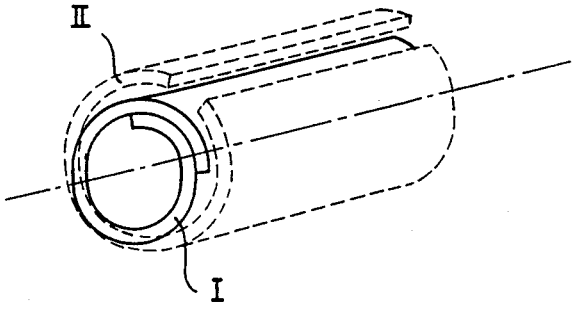

FIS. 2*a* and 2*b* show, by way of non-limiting example, how the couplings shown in FIGS. 1*a* and 1*b* may be used for connecting cables of a given type;

FIGS. 3*a* and 3*b* are respectively a perspective view and a longitudinal section view through a particularly advantageous application of a coupling in accordance with the present invention to connecting the rear portion of a contact in a releasable connector with an item for electrical connection to said contact; and FIGS. 4*a*, 4*b*, and 4*c* show a particularly advantageous method of making a coupling in accordance with the present invention.

MORE DETAILED DESCRIPTION

A coupling for interconnecting electrical contact zones and in accordance with the present invention is described, initially with reference to FIGS. 1*a* and 1*b*.

First, as shown in said figures, a coupling in accordance with the invention comprises a split sleeve 1 made of a material having shape memory. The sleeve is capable of occupying a first state of memorized shape, referened I, which corresponds substantially to the initial shape state of the sleeve. In this first state, electrical and mechanical interconnection are provided between the electrical contact zones to be interconnected.

Additionally, the sleeve 1 is capable of occupying a second state of memorized shape, referened II, which shape is obtained by local modification of at least one zone of the sleeve structure. In this second state, the electrical contact zone may be freely inserted into or removed from a central zone of the sleeve. The sleeve may be caused to pass reversibly back and forth between its state by changing the temperature of at least one local zone of the sleeve structure. The term "local zone of the sleeve structure" is used with a sleeve of substantially cylindrical shape, for example, to designate a zone in the vicinity of one of the generator lines of the surface of the sleeve. Naturally, the sleeve may be caused to pass from one of its memorized shape states to the other by changing the temperature of one or more such local zones, or by changing the temperature of entire sleeve.

By way of non-limiting example, tests on couplings in accordance with the invention have led to the material having shape memory being selected from metal compositions in the group: nickel-titanium, nickel-titanium-iron, copper-zinc-aluminum, copper-aluminum-nickel, and nickel-aluminum. These materials may be used in the form of intermetallic compounds or in the form of alloys.

By way of a particularly advantageous example, a coupling in accordance with the invention has been made using 4% aluminum, 28% zinc and with the remaining percentage being copper. In the above, example, it must be mentioned that the first memorized shape state I is stable at ambient temperature and/or at the operating temperature of the electrical connection. Naturally, this first memorized shape state is stable at low temperature, i.e. down to the lowest temperature of the specification which defines the range of temperatures over which the coupling is to be used. The first memorized shape state is thus selected to be stable down to a temperature of about −65° C. The second memorized shape state is obtained when the temperature of at least one local zone of the sleeve structure (or of the entire sleeve) is reduced to a temperature below the transition temperature Ms of the material from which the sleeve is made. In the above example, the transition temperature Ms of the alloy described is about −80° C. Any suitable source of low temperature is capable of causing the sleeve to pass from memorized shape I to memorized shape II, with the thermal inertia of the sleeve at temperatures below the transition temperature being sufficient to enable engagement and/or disengagement operations of the electrical contact zone to be performed in the central zone of the sleeve.

Thus, as shown in FIG. 1*a*, the sleeve in its first memorized shape state I is wound in a configuration such that the edges of the slot 10 are disjoint, with the walls of the sleeve in the vicinity of the edges of the slot overlapping each other so that the sleeve is wound into a spiral with turns which are partially in contact. This embodiment is particularly advantageous for interconnecting electrical contact zones of substantially circular section.

FIG. 1*b* shows another embodiment in which the first memorized shape state I of the sleeve is oblong or flattened, with the edges of the slot being disjoint and with the sleeve walls which occupy the vicinity of the slot edges overlapping as in the FIG. 1*a* example. This embodiment appears to be more particularly adapted to connecting so-called "flat" cables.

It is preferable, but not essential for the inside walls of the sleeve to be smooth. This makes it possible, when interconnecting cables which have stripped end portions projecting from an insulating sheath, to cover the sheath adequately without damaging it.

In order to provide better resistance to ageing and to external agents, the sleeve may also include a conductive protective covering constituted by a layer of gold, silver, palladium alloy, a tin-lead compound, or titanium. The protective covering may, additionally, include a suitable undercoat.

Figure 2A:
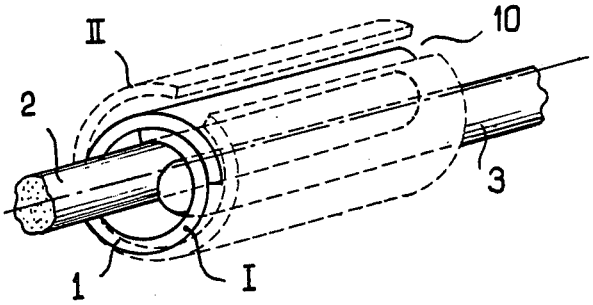
Figure 2B:
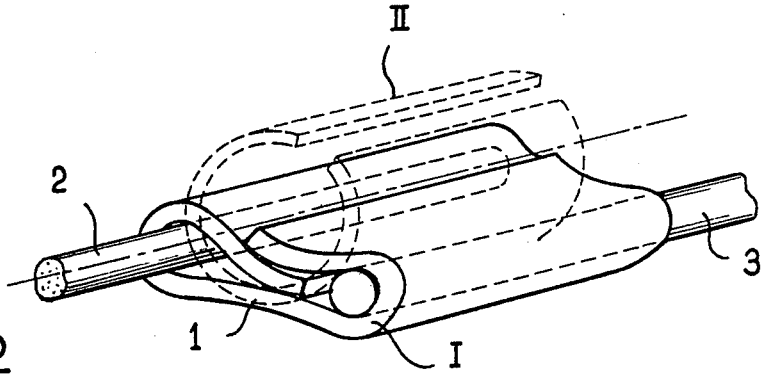

The use of a coupling in accordance with the present invention is now described with reference to FIGS. 2a and 2b. Starting with the sleeve 1 in its initial memorized shape state I, the sleeve is changed to its memorized shape state II by means of a cold source or of a tool capable of reducing the sleeve temperature to below its transition temperature Ms. While it is in memorized shape state II, the edges of the slot 10 are preferably disjoint, and the central zone of the sleeve is open sufficiently widely to enable the electrical contact zones 2 and 3 of suitable section to be inserted into the central zone of the sleeve 1. When the sleeve returns to its initial temperature or to ambient temperature, it also returns to memorized shape state I, thereby ensuring electrical and mechanical interconnection of the electrical contact zones 2 and 3. Naturally it is advantageous for the gap in the slot 10 when the sleeve is in its memorized shape state II to be wide enough to enable the sleeve to be placed over pre-wired electrical contact zones. FIG. 2*b* shows a flat sleeve it its memorized shape state I, with contact zones which may either be conductors of circular cross section, or else conductors of the type used in flat cables.

There follows a description of a particularly advantageous application of a coupling in accordance with the present invention to connecting the rear portion 4 of a wire-wrap connector post 5. This description is made with reference to FIGS. 3*a* and 3*b*.

The connector post 5 is placed on the end portion 4 of the connector contact, and the sleeve 1 while in its shape state II (as described above) is placed over the junction between the the connector contact 4 and the connector post 5 while the gap in its slot is large enough. The junction zone is located in the middle of the open sleeve. On returning to ambient or operating temperature, the sleeve returns to its first memorized shape state I in which electrical and mechanical interconnection is ensured between the electrical contact zones constituted by the contact 4 and the connector post 5. Preferably, when the sleeve 1 is in its memorized shape state I, it is wound in a configuration such that the edges of its slot 10 are substantially in contact with each other.

In order to prevent the connector post 5 from rotating relative to the contact 4, the connector post 5 may be provided with facets at sharp angles in the vicinity of the sleeve and the edges of the central zone of the sleeve may be complementary in shape to the portion of the connector post and/or the rear portion of the connection contact with which it is associated To this end, and as shown in FIGS. 3*a* and 3*b*, the edges of the sleeve 1 other than those which define the slot 10 are provided with indentations, e.g. rectangular section notches 100 so as to enable the sleeve 1 to deform and pass between the first memorized shape state and the second memorized shape state, while allowing the body of the sleeve to bend.

Likewise, in order to provide improved mechanical cohesion and better electrical contact between the parts 4 and 5 to be interconnected, the body of the sleeve 1 includes at least one portion 101 which is inclined relative to the transverse plane of symmetry P of the sleeve so as to form a facet sloping relative to the central portion 102 of the sleeve body. The, or each, facet 101 is (are) symmetrically placed about the plane P and is (are) disposed between the notches 100 and the central portion 102 of the sleeve body.

It will be understood that when passing from memorized shape state II to state I, i.e when the sleeve closes, the symmetrical inclined planes formed by the facet 102 have a wedging effect which sets up opposing forces about the plane of symmetry P on each of the parts 4 and 5 to be connected, thereby encouraging their mechanical and electrical interconnection.

The above application is particularly advantageous for making connections with releasable connectors of the hermetically sealed type, in which conventional connection technques are not easily used by virtue of the volume available for implementing such a connector or by virtue of the conditions in which the connector is to be used. In particular, the material from which the contacts are made is not suitable for withstanding the kinds of deformation which normally when using conventional coupling techniques.

An example of an implementation of a coupling in accordance with the invention is now described with reference to FIGS. 4*a*, 4*b*, and 4*c*.

As shown in FIG. 4*a*, the coupling may be obtained from a sheet of the above-specified alloy which is cut into a strip of suitable size, with said sheet being given an overall reference 20. If rectangular teeth or notches 100 as shown in FIG. 3*a* and 3*b* are required, they may be cut from the strip by cutting along its edges, and the strip 20 may then be folded to form the facet or inclined portions 101. The strip 20 is then rolled mechanically as indicated by arrow R so as to constitute a split sleeve and so as to impart the final shape and size to the sleeve which constitute its first memorized shape state I, as shown in FIG. 4*b*. The sleeve 1 is then subjected to heat treatment suitable for converting its crystallographic phase to a phase of the austenitic type and it is then cooled to a temperature close to ambient temperature. The cooling is performed in a manner, e.g. by quenching, suitable for preventing the appearance of an unwanted crystallographic phase.

A so-called "education" process is then applied to the sleeve 1, at least along a deformation zone thereof which extends substantially along one or several generator lines of the sleeve wall. In FIG. 4*b* the zone which is subjected to "education" is referenced 111.

The "education" consists in repetitively applying mechanical stress to the deformation zone 111, or to a plurality of such zones, such that the sleeve is deformed in said deformation zones so as to bring the sleeve to a shape close to the second memorized shape state II, and in subjecting the entire assembly while the stress is being applied to a temperature reduction suitable for bringing the, or each, deformation zone 111 (and optionally the entire sleeve assembly 1) to a martensitic phase state. The temperature reduction may be caused by any suitable source of cold which is applied either to the entire sleeve or else solely to the, or each, deformation zone 111. The mechanical stress may be applied by means of a tool suitable for separating separating the edges of the slot 10 far enough to obtain the desired memorized shape state II.

After the mechanical stress is removed, a coupling in accordance with the invention is progressively reheated to ambient temperature. It then returns to its stable or first memorized shape state.

The "education" cycle as defined above must be repeated often enough to ensure that a high degree of reproducibility is subsequently obtained between the first and second memorized shape states merely by reducing the temperature and then raising the temperature in order to return to the initial memorized shape status.

The above-described "education" process is not the only possible "education" process, and any other process capable of obtaining two memorized shape states which can be reversibly interchanged solely by varying the temperature can be used within the scope of the invention.

The above method of making a coupling in accordance with the invention by cutting an rolling a strip of suitable material is not the only possible method. Coupling components of substantially the same shape may also be obtained from material having shape memory and delivered in the form of rods, cylindrical bars, or the like, by conventional machining operations such as drilling.

Similarly, the above-described "education" process may be performed in a complementary manner, i.e. by using an education process in which the temperature variations for passing from memorized shape state I to state II are inverted, and with the specific shape designated by said state numbers being inverted, is necessary.

Finally, by way of non-limiting example, it may be mentioned that the protective covering is preferably applied to the "educated" material by any conventional means such as electrofacing, and it may optionally be applied to the material prior to the "education" process.

We claim:

1. An electrical coupling for interconnecting electrical contact zones, the coupling being in the form of a split sleeve of a material having shape memory, said sleeve being capable of occupying:

a first memorized shape state corresponding substantially to the initial shape state of the sleeve, said shape being suitable for ensuring electrical and mechanical interconnection of the electrical contact zones; and a second memorized shape state which is obtained by local modification of at least one zone of the sleeve structure, said second shape being suitable for allowing the electrical contact zones to be freely inserted and/or removed from the central zone of the sleeve;

the sleeve being reversibly passable between said shape states solely by modifying the temperature of at least one local zone of the sleeve structure.

2. A coupling according to claim 1, wherein said material having shape memory is constituted by a metal composite selected from the group constituted by: nickel-titanium, nickel-titanium-iron, copper-zinc-aluminum, copper-aluminumnickel, and nickel-aluminum; said composite being used in the form of an alloy or of an intermetallic compound.

3. A coupling according to claim 1, including a conductive protective covering constituted by a layer of gold, silver, palladium alloy, tin-lead compound, or titanium, said protective covering further including a suitable undercoat.

4. A coupling according to claim 1, wherein the inside walls of the sleeve are smooth.

5. A coupling according to claim 1, wherein the coupling is for use in connecting the rear portion of a connector contact with a wire-wrap type post, said sleeve having a first memorized shape state in which it ensures electrical and mechanical interconnection of the electrical contact zones in which it is wound into a configuration such that the edges of the sleeve slot are substantially in contact with each other.

6. A coupling according to claim 1, wherein said sleeve, when in said first memorized shape state for ensuring electrical and mechanical interconnection of said electrical contact zones, is wound in a configuration such that the edges of its slot are disjoint, with the walls of said sleeve in the vicinity of the edges of said slot overlapping each other.

7. A coupling according to claim 6, wherein the sleeve is additionally substantially flattened in its first memorized shape state.

8. An electrical coupling for interconnecting electrical contact zones, the coupling being in the form of a split sleeve of a material having shape memory, said sleeve being capable of occupying:

a first memorized shape state corresponding substantially to the initial shape state of the sleeve, said shape being suitable for ensuring electrical and mechanical interconnection of the electrical contact zones; and a second memorized shape state which is obtained by local modification of at least one zone of the sleeve structure, said shape being suitable for allowing the electrical contact zones to be freely inserted and/or removed from the central zone of the sleeve;

the sleeve being reversibly passable between said shape state by modifying the temperature of at least one local zone of the sleeve structure, wherein the coupling is for use in connecting the rear portion of a connector contact with a wire-wrape type post, said sleeve having a first memorized shape state in which it ensures electrical and mechanical interconnection of the electrical contact zones in which it is wound into a configuration such that the edges of the sleeve slot are substantially in contact with each other, said central zone of the sleeve when in its first memorized shape state is complementary in section to the rear portion of the connector contact and to the wire-wrap post.

9. A coupling according to claim 8, wherein the edges of the sleeve other than those which define said slot are provided with notches or indentations suitable for allowing said sleeve to deform and to pass from said first memorized shape state to said second memorized shape state by bending.

10. A coupling according to claim 9, wherein the body of the sleeve includes a portion is inclined relative to the transverse plane of symmetry thereof, said portion constituting a facet relative to the central portion of the body, and said facet being disposed between said notches and the central portion of the sleeve body.

* * * * *

UNITED STATES PATENT AND TRADEMARK OFFICE

CERTIFICATE OF CORRECTION

PATENT NO. : 4,810,201

DATED : March 7, 1989

INVENTOR(S) : Michel de Mendez; Jean J. Negre; Gerard Guenin and Guy Herubel

It is certified that error appears in the above-identified patent and that said Letters Patent is hereby corrected as shown below:

On the front page format of the patent, after Paragraph [22], insert the following paragraph:

--[30] Foreign Application Priority Data
July 19, 1985 France.....85.11088--

Signed and Sealed this

Twenty-first Day of November, 1989

*Attest:*

JEFFREY M. SAMUELS

*Attesting Officer* *Acting Commissioner of Patents and Trademarks*